US005279395A

United States Patent [19]

Willis et al.

[11] Patent Number: 5,279,395

[45] Date of Patent: Jan. 18, 1994

[54] RAILWAY CAR BRAKE SYSTEM

[75] Inventors: William L. Willis, Fenton; William T. Deet, Pacific; John A. Krug, St. Charles, all of Mo.

[73] Assignee: ACF Industries, Incorporated, Earth City, Mo.

[21] Appl. No.: 980,122

[22] Filed: Nov. 23, 1992

Related U.S. Application Data

[63] Continuation of Ser. No. 701,117, May 16, 1991, abandoned.

[51] Int. Cl.[5] ..... F16D 65/40

[52] U.S. Cl. ..... 188/198; 188/47

[58] Field of Search ..... 188/33, 46, 47, 52-54, 197-202

[56] References Cited

U.S. PATENT DOCUMENTS

| | | | |
|---|---|---|---|
| 2,134,789 | 11/1938 | Hoke | 188/46 |
| 2,146,212 | 2/1939 | Hansen | 188/46 |
| 2,762,459 | 9/1956 | Flowers | 188/46 X |
| 3,096,859 | 7/1963 | Showers, Jr. et al. | 188/202 X |
| 3,130,820 | 4/1964 | Feuilly | 188/199 |
| 3,420,339 | 1/1969 | Karakashian et al. | 188/47 |
| 4,147,237 | 4/1979 | Mulcahy | 188/52 |
| 4,479,567 | 10/1984 | Pearson | 188/199 X |

FOREIGN PATENT DOCUMENTS

| | | | |
|---|---|---|---|
| 267530 | 5/1988 | European Pat. Off. | 188/198 |
| 610315 | 9/1926 | France | 188/46 |
| 1197900 | 12/1985 | U.S.S.R. | 188/52 |

*Primary Examiner*—Robert J. Oberleitner
*Assistant Examiner*—Alfred Muratori
*Attorney, Agent, or Firm*—Polster, Lieder Woodruff & Lucchesi

[57] ABSTRACT

An improved brake linkage system for a railway car, especially a hopper car, having an air cylinder actuated to move a cylinder lever. The cylinder lever is directly connected to a floating operating lever by a slack adjuster which can be made substantially shorter, lighter and less expensive than slack adjusters of prior art systems. With respect to the prior art, the present invention permits use of less linkages, shorter linkages and lighter linkages, thus making the overall linkage system lighter, less expensive and more efficient.

4 Claims, 4 Drawing Sheets

RAILWAY CAR BRAKE SYSTEM

This application is a continuation of Ser. No. 07/701,117 filed May 16, 1991 now abandoned.

This invention relates to brake systems for slowing and stopping railway cars and more particularly to an improved mechanical linkage for applying a substantially even braking force to all of the wheels of a railway car in response to the actuation of an air brake cylinder conventionally associated with a pneumatic brake line running from car to car of a railway train.

Air brake systems for railway cars commonly employ a plurality of levers, rods, links and other mechanical force transmitting members to evenly transmit the force created by the pneumatic brake line and air brake cylinder to the brakes associated with each wheel of the railway car. It is the goal of the railway car brake engineer to strive to improve the mechanical brake linkage system by 1) reducing the number of force transmitting members to thereby increase the efficiency of the system; 2) reduce the size of the force transmitting members to reduce the overall weight of the system thereby permitting additional lading weight and effecting greater transportation economy; and 3) using less expensive components in the system to produce economy in manufacture and repair.

SUMMARY OF THE INVENTION

It is an object of the present invention to provide an improved railway car brake linkage system having a reduced number of force transmitting members and greater efficiency.

It is a further object to provide an improved railway car brake linkage system having reduced size and weight.

It is a still further object to provide an improved brake linkage system utilizing less expensive components.

Generally stated, the improved railway car brake linkage system includes a fulcrummed cylinder lever connected to the air brake cylinder for movement upon actuation of the brake cylinder. The fulcrummed cylinder lever is connected to a floating operating lever by a slack adjuster which is substantialy shorter than slack adjusters currently used in the art. The floating operating lever is connected at one end thereof via a pivot joint to the truck brake lever at the near end of the railway car. The floating operating lever is connected at the other end thereof to a long brake rod which extends to the far end of the car. The far end of the brake rod is connected to a second operating lever which in turn is connected to the truck brake lever at the far end of the car. This novel brake linkage system when compared to a prior art system permits the use of a relatively short, less expensive and lighter slack adjuster and eliminates two linkages, thus reducing the overall weight and increasing the efficiency of the system.

These as well as other objects and advantages will become more apparent upon a reading of the detailed description of a preferred embodiment in conjunction with the drawings wherein:

DETAILED DESCRIPTION OF THE PREFERRED EMBODIMENT

Figure 1:
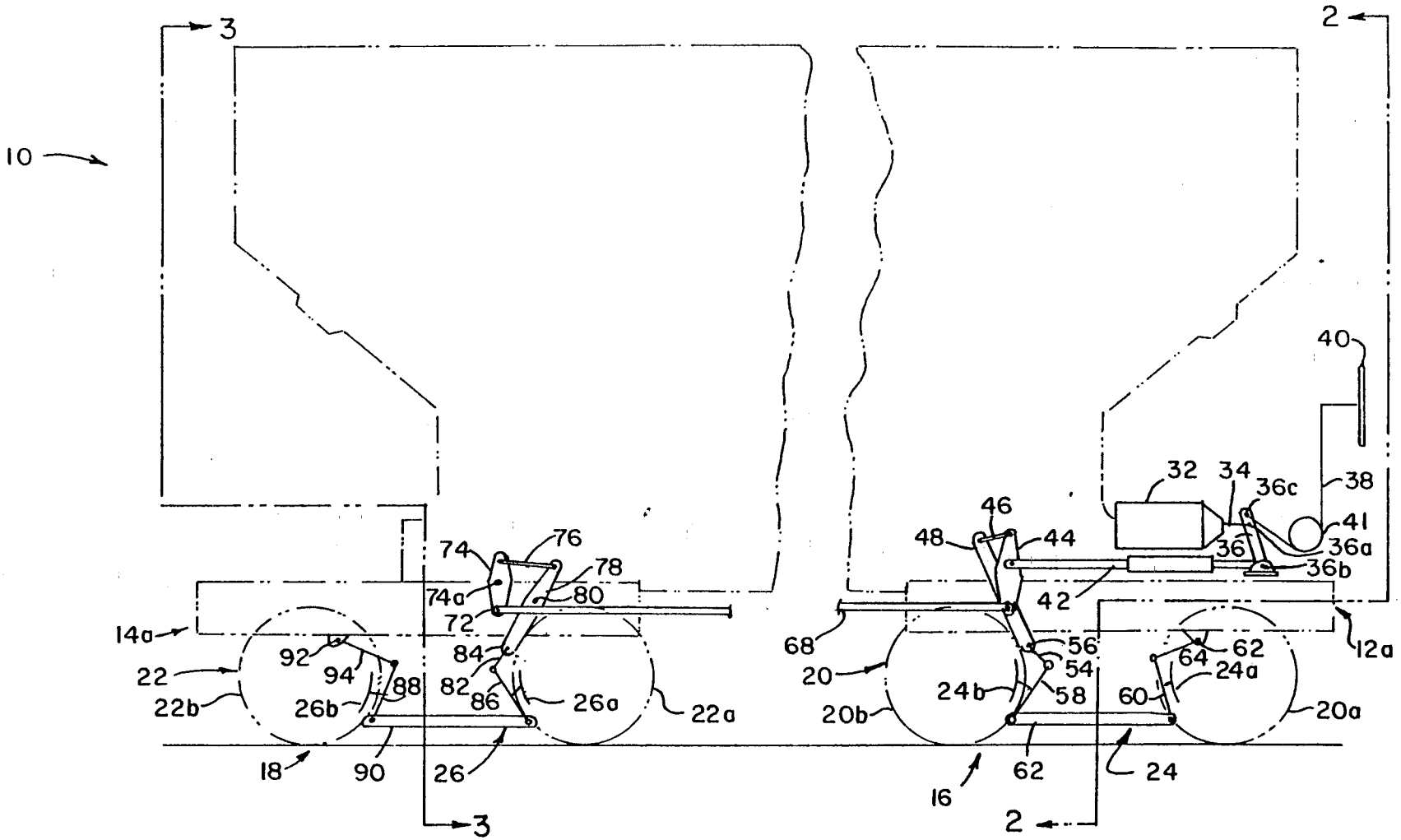
FIG. 1 is a schematic representation of a side view of the ends of a railway hopper car illustrating an improved brake linkage system according to the principles of the present invention.
Figure 2:
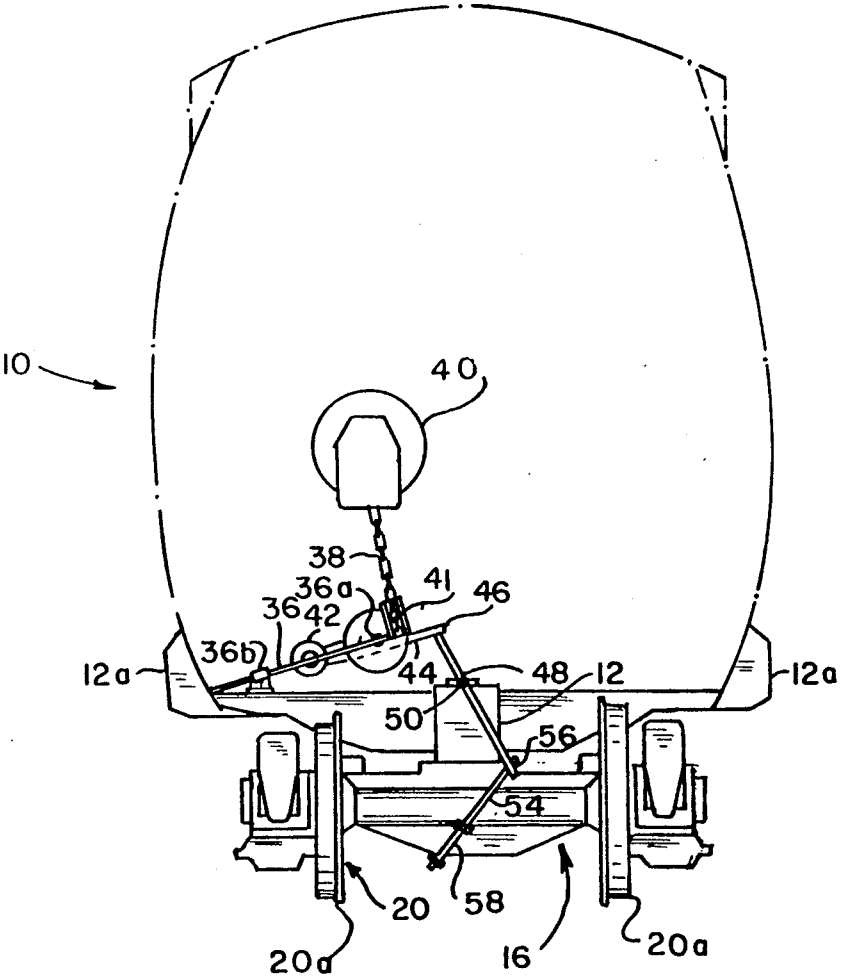
FIG. 2 is a schematic representation of the end view of the car taken along line 2—2 of FIG. 1.
Figure 3:
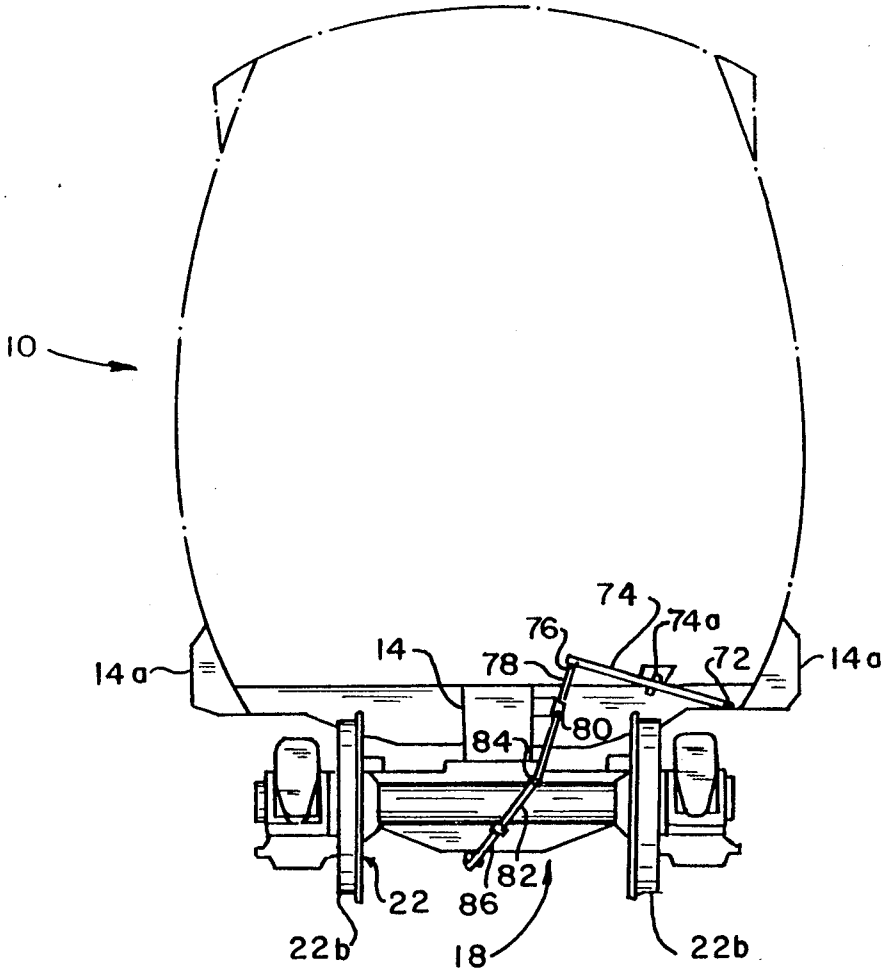
FIG. 3 is a schematic representation of the end view of the car taken along line 3—3 of FIG. 1.

With reference to the drawings, wherein corresponding reference characters indicate corresponding elements throughout the several views, there is shown in phantom line a railway car 10, for example, a covered hopper car designed to carry a dry lading and which is adapted to be connected on either end to additional railway cars to form a train of coupled cars. Car 10 is supported on the right hand end as shown in FIG. 1, and sometimes referred to hereinafter as the near end of the car, by a conventional center stub sill assembly 12 which carries side sills 12*a* (FIG. 2). Car 10 is supported on the left hand end as shown in FIG. 1 by center stub sill assembly 14 which carries side sills 14*a* (FIG. 3). Center stub sills 12 and 14 are each carried by respective conventional truck assemblies 16 and 18. Truck assembly 16 includes a set of four wheels 20 including a near pair 20*a* and a far pair 20*b*. Truck assembly 18 also includes a set of four wheels 22 including a near pair 22*a* and a far pair 22*b*. Wheel sets 20 and 22 are adapted to ride on track (not shown) in the conventional manner.

Truck assembly 16 is provided with brake assembly 24 having a near pair of brake shoes 24*a* adapted to frictionally engage near pair of wheels 20*a* and a pair of far brake shoes 24*b* adapted to frictionally engage far pair of wheels 20*b*. Truck assembly 18 likewise is provided with brake assembly 26 having a near pair of brake shoes 26*a* adapted to frictionally engage near pair of wheels 22*a* and a pair of far brake shoes 26*b* adapted to frictionally engage far pair of wheels 22*b*.

The description of the structure thus far is conventional and has been set forth to provide a context for the improved brake linkage system to be described hereinbelow.

Figure 4:
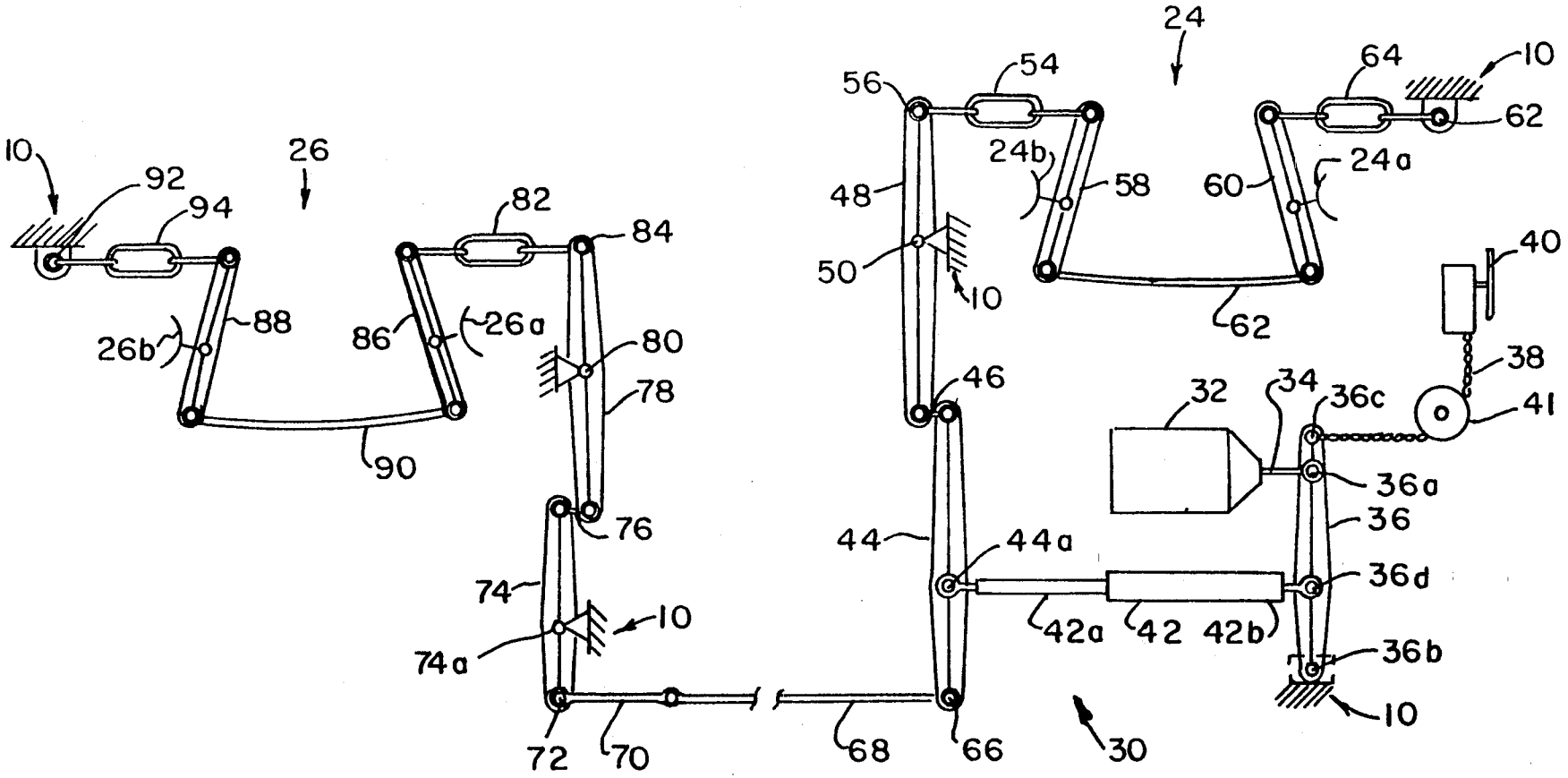
FIG. 4 is a representational diagram showing the novel brake linkage system of the invention.

With particular reference to FIGS. 1 and 4, the improved brake linkage system, generally indicated by numeral 30, includes pneumatic cylinder 32 mounted on the near end of car 10. Cylinder 32 is connected to a pressurized brake line (not shown) which runs from car to car and which when activated, causes the piston rod 34 of cylinder 32 to move outwardly away from cylinder 32 and away from car body 10 to cause the brakes to be applied to the wheels as will explained in greater detail hereinafter. The free end of piston rod 34 is pinned for relative pivotal movement with a cylinder lever 36 at pivot point 36*a*. Cylinder lever 36 is pivotally pinned to a fulcrum point 36*b* which is fixed to car 10. As seen in FIG. 2, cylinder lever 36 extends generally horizontally and upwardly from fulcrum point 36*b* to a free end 36*c*. Free end 36*c* of cylinder lever 36 is connected via a length of chain 38 to a handbrake wheel 40. In the event the brakes are to be applied manually, handbrake wheel 40 is turned to take up a portion of chain 38 which moves around sheave wheel 41 to pull cylinder lever 36 away from cylinder 32 to thereby cause the same linkage movement as would be the case when cylinder 32 is actuated, as will be described hereinafter.

Between pivot points 36*a* and 36*b* on cylinder lever 36 there is pivotally connected thereto at pivot point 36*d* one end of a slack adjuster 42. Slack adjusters are known in the art and include a small diameter cylindrical portion 42*a* and a telescopically mating larger diameter cylindrical portion 42*b*. Slack adjuster 42 compensates for slack in the linkage system due to brake shoe wear by automatically shortening when slack is present. Due to the novel positioning of slack adjuster 42 in brake system 30, slack adjuster 42 is substantially shorter than prior art slack adjusters. In the preferred embodiment, slack adjuster 42 is only about sixty inches long. Slack adjuster 42 is pivotally connected at the far end thereof to a suspended floating operating lever 44 at an intermediate pivot point 44*a*. Operating lever 44 is substantially horizontal as best seen in FIG. 2 and is located inboard of cylinder 32. Operating lever 44 is directly pivotally connected at one end thereof through a clevis link 46 to a substantially vertically extending fulcrummed brake lever 48. Lever 48 is pivotally connected intermediate the ends thereof to car 10 at pivot point 50. The opposite free end of lever 48 is pivotally attached to link 54 at point 56. Link 54 communicates with brake assembly 24 which includes truck levers 58 and 60 carrying brake shoes 24*b* and 24*a*, respectively. Truck lever 58 communicates with lever 60 through brake rod 62, and lever 60 is connected to car body 10 at point 62 through link 64.

Floating operating lever 44 is pivotally connected at the opposite end thereof at point 66 to a long brake rod 68 which extends longitudinally along one side of car 10 between near truck assembly 16 and far truck assembly 18. Long brake rod 68 includes a pivoted section 70 which terminates at pivot point 72 which is at one end of substantially horizontal fulcrummed operating lever 74. Operating lever 74 is fulcrummed at intermediate point 74*a* thereof fixed to car 10. The other end of fulcrummed operating lever 74 is directly connected via clevis link 76 to one end of a substantially vertical fulcrummed brake lever 78 which pivots on fulcrum point 80 fixed to car 10. The opposite end of brake lever 78 is pivotally attached to link 82 at point 84. Link 82 communicates with brake assembly 26 which includes truck levers 86 and 88 carrying brake shoes 26*a* and 26*b*, respectively. Truck lever 86 communicates with lever 88 through brake rod 90, and lever 88 is connected to car body 10 at point 92 through link 94.

In operation, when the brakes 24*a*, 24*b*, 26*a*, 26*b* are to be applied to slow or stop car 10, an air pressure signal is transmitted to cylinder 32 which causes piston rod 34 to extend outwardly to the right as seen in FIG. 4. Cylinder lever 36 pivots to the right about fulcrum point 36*b* tensioning slack adjuster 42 and pulling floating operating lever 44 to the right. Movement of operating lever 44 causes operating lever 74 to pivot about fulcrum point 74*a*; i.e., pivot point 72 moves to the right and clevis link 76 moves to the left. Now it can be seen that both brake levers 48 and 78 are pivoted about their respective fulcrums 50 and 80 to cause tensioning of respective brake assemblies 24 and 26. When tensioned, conventional brake assemblies 24 and 26 cause the brake shoes 24*a*, 24*b*, 26*a* and 26*b* to frictionally engage the wheels in a know manner to exert a substantially even frictional force against movement of each of the wheels.

Figure 5:
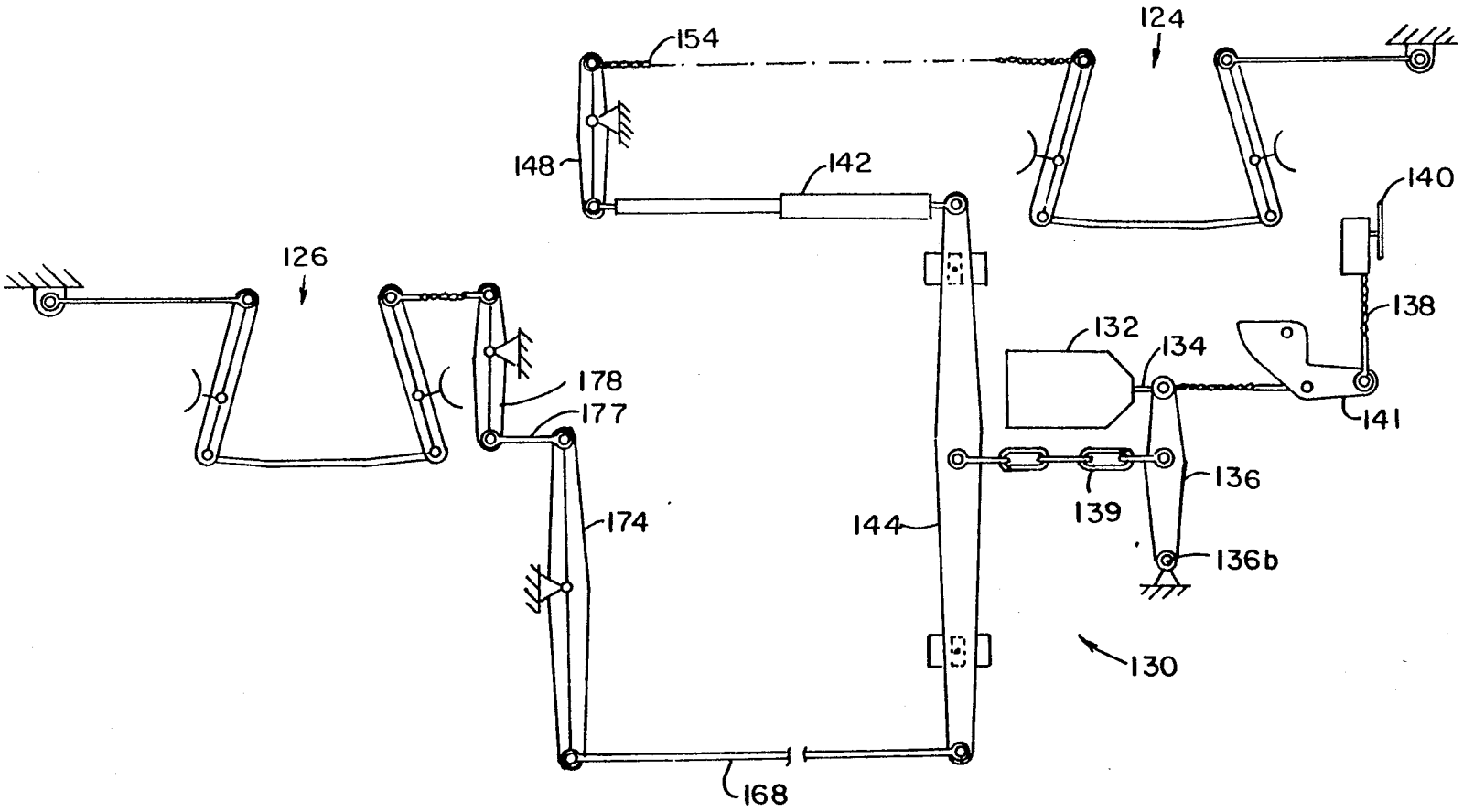
FIG. 5. PRIOR ART.
FIG. 5 is a representational diagram showing a prior art brake linkage system.

The preferred embodiment of the novel brake linkage system 30 detailed hereinabove fulfills the objects and obtains the advantages set forth herein with respect to the closest prior art which is diagramatically shown in FIG. 5. Prior art brake linkage system 130 includes air brake cylinder 132 with piston rod 134 connected to cylinder lever 136 which pivots about fixed fulcrum point 136*b*. Handbrake wheel 140 connected to chain 138 and bell crank 141 operates similar to the handbrake of FIG. 4. When cylinder lever 136 is pivoted to the right, as seen in FIG. 5, tension is put on chain 139 which moves a large sliding floating operating lever 144 to the right. One end of operating lever 144 pulls on long brake rod 168 and the other end pulls on a slack adjuster 142 which due to its positioning in the system must be much longer, heavier and more expensive than slack adjuster 42 of the present invention. The opposite end of prior art slack adjuster 142 is connected to brake lever 148 which in turn is connected to chain linkage 154 which operates brake assembly 124. Brake rod 168 moves fixed fulcrum operating lever 174 which is connected to brake lever 178 by a link 177. Brake lever 178 pivots to operate brake assembly 126.

It can thus be seen that by placing slack adjuster 42 between cylinder lever 36 and operating lever 44 many of the heretofore mentioned objects and advantages of the present invention are obtained. Slack adjuster 42 compensates directly for brake shoe wear for both brake assemblies 24 and 26 and due to its novel positioning requires less total travel to compensate for the wear; i.e., approximately ten inches as opposed to about twenty-one inches in the prior art system 130. Therefore, slack adjuster 42 may be made much shorter than the prior art; i.e., only about sixty inches. As compared to prior art system 130, novel brake linkage system 30 has eliminated two large links. Further, operating lever 44 has been made much smaller, lighter and less expensive to fabricate. Overall, the brake system 30 of the invention is approximately three hundred fifty pounds lighter than the prior art brake system 130. Due to the elimination of linkages, novel brake system 30 has been found to be eight per cent more efficient than the prior art system 130.

Inasmuch as some modification can be made in the improved brake linkage system of the present invention without departing from the spirit and scope thereof, the scope of the invention is to be determined solely by the language of the appended claims.

Having thus described the invention, what is claimed and desired to be secured by Letters Patent is:

1. An improved brake linkage system for a railroad car having truck assemblies at each end thereof, each said truck assembly having a set of wheels and an associated brake assembly for each said wheel set, the respective brake assemblies exerting a braking force on their associated set of wheels when said linkage system is activated, and cylinder means for exerting a force on said brake linkage system to activate the system to brake said car, said brake linkage system comprising:

a cylinder lever attached to said cylinder means, one end of said cylinder lever being pivotally attached to said railroad car, and the opposite end of said cylinder lever being attached to said cylinder means for said cylinder means to move said cylinder lever about its pivotally attached end;

an operating lever movable by the cylinder lever when the cylinder means moves the cylinder lever about its pivot;

a brake lever pivotally mounted to said railroad car at a point intermediate the ends of the brake lever, one end of said brake lever being connected to a brake assembly for one of the sets of wheels at one end of rail car, and the opposite end of said brake lever being connected to one end of said operating lever for movement of said operating lever to cause movement of said brake lever about its pivot for said brake assembly connected to said brake lever to engage its associated set of wheels; and, a slack adjuster interconnecting said cylinder lever and said operating lever for movement of said cylinder lever by said cylinder means to produce movement of said operating lever one end of said slack adjuster being attached to said cylinder lever at a point intermediate the ends of said cylinder lever and to said operating lever also at a point intermediate the ends thereof.

2. The improved brake linkage system of claim 1 further including:

a second brake lever pivotally mounted to said railroad car at the end thereof opposite to the end at which the first said brake lever is pivotally mounted thereto, said second brake lever being pivotally mounted to said railroad car also at a point intermediate the ends of said second brake lever, one end of said second brake lever being connected to the brake assembly for said set of wheels at said opposite end of said railroad car;

a second operating lever one end of which is connected to the other end of said brake lever for movement of said second operating lever to move said second brake lever, said second operating lever being pivotally mounted to said railroad car at a point intermediate the ends of said second operating lever; and, a rod interconnecting said first and second operating levers, said rod extending between the end of the first said operating lever not connected to the first said brake lever, and the end of said second operating lever not connected to said second brake lever, whereby movement of the first said operating lever by said slack adjuster also produces movement of said second operating lever thereby to simultaneously activate the brake assembly for the respective sets of wheels at each end of said car.

3. The improved brake linkage system of claim 1 wherein the first said operating lever is a floating lever and one end of said slack adjuster is connected to the first said operating lever at a point intermediate the ends thereof.

4. The improved brake linkage system of claim 3 further including means attached to the same end of said cylinder lever as said cylinder means for manually moving said cylinder lever to activate the respective brake assemblies.

* * * * *